US011992749B2

(12) United States Patent
Rhoades

(10) Patent No.: US 11,992,749 B2
(45) Date of Patent: May 28, 2024

(54) PORTABLE BOWLING SYSTEM AND METHOD OF USE

(71) Applicant: Alexander Rhoades, Alto, NM (US)

(72) Inventor: Alexander Rhoades, Alto, NM (US)

( * ) Notice: Subject to any disclaimer, the term of this patent is extended or adjusted under 35 U.S.C. 154(b) by 0 days.

(21) Appl. No.: 18/138,719

(22) Filed: Apr. 24, 2023

(65) Prior Publication Data

US 2023/0347233 A1 Nov. 2, 2023

Related U.S. Application Data

(60) Provisional application No. 63/336,266, filed on Apr. 28, 2022.

(51) Int. Cl.
*A63D 3/00* (2006.01)
*A63D 1/02* (2006.01)
*A63D 5/06* (2006.01)

(52) U.S. Cl.
CPC *A63D 1/02* (2013.01); *A63D 5/06* (2013.01)

(58) Field of Classification Search
CPC ..... A63D 1/02; A63D 5/06; A63D 3/00
See application file for complete search history.

(56) References Cited

U.S. PATENT DOCUMENTS 612,198 A * 10/1898 Ehmer ..... A63F 7/0005 273/127 R
1,931,841 A 10/1933 Evans
1,979,466 A 11/1934 Hedenskoog
2,236,560 A 4/1941 Bancroft
2,292,753 A 8/1942 Gerald
2,306,955 A 12/1942 Rose et al.
2,525,881 A * 10/1950 Felter ..... A63F 9/0243 273/127 R
2,566,109 A 8/1951 Robert
2,597,072 A 5/1952 Cowgill
2,627,409 A 2/1953 Breen
2,665,131 A 1/1954 Shlafender
2,857,162 A 10/1958 Zuercher
3,174,751 A * 3/1965 Erich ..... A63D 5/08 473/118
3,224,767 A * 12/1965 Webb ..... A63D 5/04 473/118
3,227,448 A * 1/1966 Groff ..... A63D 5/08 273/127 D
3,398,952 A 8/1968 Conklin et al.
(Continued)

FOREIGN PATENT DOCUMENTS

AT 236844 11/1964

*Primary Examiner* — William M Pierce

(57) ABSTRACT

The present invention relates to a portable bowling system and method of use thereof. The portable bowling system may have a frame from which bowling pins are suspended above a playing surface. The playing surface may be an uneven playing surface. A ball catcher may also be configured on the playing surface whereby the frame is configured between the ball catcher and a player. A player may insert their thumb into a thumb hole of a bowling ball and two of their fingers into finger holes of the bowling ball. The player may roll the bowling ball towards the frame whereby the bowling ball contacts one or more of the bowling pins. The bowling pins may fall to the playing surface. The bowling ball may pass beyond the frame and be stopped within the ball catcher.

21 Claims, 17 Drawing Sheets

(56) References Cited

U.S. PATENT DOCUMENTS

| | | | | |
|---|---|---|---|---|
| 3,442,511 | A * | 5/1969 | Payne, Jr. | A63D 3/00 273/127 R |
| 3,658,329 | A | 4/1972 | Ciccarello | |
| 4,220,332 | A * | 9/1980 | Mendez | A63F 9/0001 473/75 |
| 4,221,385 | A * | 9/1980 | Nidy | A63F 7/305 273/127 D |
| 4,330,130 | A * | 5/1982 | Carr | A63F 9/0204 273/393 |
| 4,564,204 | A | 1/1986 | Sullivan et al. | |
| 5,039,095 | A * | 8/1991 | Buckley | A63D 5/02 473/95 |
| 5,449,327 | A | 9/1995 | Heddon et al. | |
| 5,529,542 | A * | 6/1996 | Mansfield | A63D 5/00 473/1 |
| 5,660,596 | A * | 8/1997 | Rochefort | A63D 5/08 473/118 |
| 6,213,886 | B1 * | 4/2001 | Johnston | A63D 5/08 473/81 |
| 6,283,872 | B1 * | 9/2001 | Lichodziejewski | A63D 3/00 473/54 |
| 7,220,194 | B1 | 5/2007 | Laiacona et al. | |
| 9,004,538 | B2 | 4/2015 | Edlund et al. | |
| 11,712,637 | B1 * | 8/2023 | Hoffberg | F42B 10/64 701/2 |
| 2018/0147479 | A1 * | 5/2018 | Di Dio | A63D 5/08 |

* cited by examiner

PORTABLE BOWLING SYSTEM AND METHOD OF USE

This application claims priority of U.S. provisional patent application No. 63/336,266, filed on Apr. 28, 2022, which is hereby incorporated by reference.

BACKGROUND OF THE INVENTION

The present invention relates to the field of sporting activities, specifically the activity of bowling. Traditional bowling systems utilize large facilities with expensive equipment that is complicated and costly to manufacture, install, and maintain. These traditional bowling systems require players to travel to the bowling facilities rather than being able to play at a desired location. Furthermore, traditional bowling systems utilize standard ball sizes that require a large inventory of bowling balls of various sizes for various sized players.

Portable bowling systems do exist that allow players to play at a desired location. However, these portable bowling systems are often ill-adapted for play in certain environments, particularly outdoors where playing surfaces may be uneven. Furthermore, the portable bowling systems that exist in the art may still utilize either one size of bowling ball or various bowling balls of multiple sizes.

SUMMARY OF THE INVENTION

The present invention is related to a portable bowling system. The portable bowling system may have a frame. The frame may be configured on a playing surface. The playing surface may be an even playing surface that exists as a flat, horizontal plane. The playing surface may alternatively be an uneven playing surface that exists as a sloped plane, a horizontal plane with imperfections, or a sloped plane with imperfections. Said imperfections may exist as raises and indentations in the playing surface. Some of the components of the portable bowling system are described herein as being parallel to an even playing surface or perpendicular to an even playing surface. This description of the orientation of said components is intended to describe the configuration of said components relative to one another and is not intended to limit the use of the portable bowling system on an even playing surface.

The frame may have a crossbar that is configured parallel to an even playing surface. The crossbar may have two ends. Frame posts may extend down from each of the two ends of the crossbar whereby both frame posts are configured perpendicular to an even playing surface. Each frame post may have a crossbar end that connects to the crossbar, and a frame post feet end that connects to a foot. Feet may extend in two directions from the frame post feet end of each frame post. Each foot may have a front end and a back end. Each foot may rest on a playing surface. Said playing surface may be an even playing surface or an uneven playing surface. In some embodiments, angled bars may be configured between each frame post and the crossbar. In these embodiments, each angled bar may have a frame post end and a crossbar end. The crossbar end of each angled bar may connect to an end of the crossbar, and the frame post end of each angled bar may connect to the crossbar end of a frame post.

The frame may have pin arms that extend from the crossbar. The pin arms may extend from a single point on the crossbar. Alternatively, the pin arms may extend from multiple different points of the crossbar. The pin arms may be constructed as single units or as assemblies of multiple pin arm components. Each pin arm may have a crossbar end and a pin end. The crossbar end of each pin arm may be connected to the crossbar. The pin end of each pin arm may be removably connected to a bowling pin.

The portable bowling system may have bowling pins that each have a pin arm end and a hanging end. The pin arm end of each bowling pin may be removably connected to the pin end of a pin arm. The hanging end of each bowling pin may be suspended above a playing surface when the bowling pins are connected to the pin arms. The bowling pins may hang from the pin arms whereby the bowling pins are configured perpendicular to an even playing surface. The number of bowling pins in the portable bowling system may be at least 3. The number of bowling pins in the portable bowling system may further be at least 6. The number of bowling pins in the portable bowling system may further be at least 10. The hanging configuration of the bowling pins allow the portable bowling system to be used on an uneven playing surface since the bowling pins do not have to rest on the uneven playing surface. Therefore, the risk of the bowling pins unintentionally falling due to the uneven playing surface is eliminated by the hanging configuration of the bowling pins.

The bowling pins may be connected to the pin arms by use of magnets. A pin magnet may be configured at the pin arm end of each bowling pin. A pin arm magnet of opposite polarity may be configured at the pin end of each pin arm. The magnets may be strong enough to suspend the bowling pins above a playing surface. The magnets may also be weak enough that the connection between the bowling pins and the pin arms is broken when the bowling pins are struck by a bowling ball. The strength of the magnets of the pin arms and/or the strength of the magnets of the bowling pins may be adjusted by a player in order to strengthen or weaken the magnetic connection between the bowling pins and pin arms.

The bowling pins may alternatively be connected to the pin arms by use of suction cups. A suction cup may be configured at the pin end of each pin arm. The connection between a bowling pin and a pin arm may be formed by pressing the pin arm end of a bowling pin against a suction cup whereby a low-pressure area is created between the suction cup and the pin arm end of the bowling pin, thereby creating "suction" between the pin arm and the bowling pin. The suction between the bowling pins and the pin arms may be strong enough to suspend the bowling pins above a playing surface. The suction between the bowling pins and the pin arms may also be weak enough that the connection between the bowling pins and the pin arms is broken when the bowling pins are struck by a bowling ball.

The bowling pins may alternatively be connected to the pin arms by use of vacuums. One or more vacuums may be implemented within the portable bowling system. Each pin arm may exist as a hollow tube connected to a motor fan. One or more motor fans may be implemented in the portable bowling system. The pin ends of the pin arms may be open to allow air to enter the pin arms. The motor fan(s) may rotate, which may cause air to move from outside of the pin arms towards the motor fan via the pin arms, thereby creating suction between the pin arms and the bowling pins. The suction between the bowling pins and the pin arms may be strong enough to suspend the bowling pins above a playing surface. The suction between the bowling pins and the pin arms may also be weak enough that the connection between the bowling pins and the pin arms is broken when the bowling pins are struck by a bowling ball.

The bowling pins may alternatively be connected to the pin arms by use of strings. A pin loop of a string may be configured around the pin arm end of each bowling pin. A pin arm loop of said string may be configured around the pin end of each pin arm. Due to the shape of the bowling pins, each bowling pin may have a narrow neck portion near the pin arm end around which the pin loop of the string is configured. The cross sections of the portions of the bowling pin on either side of the neck may be wider than the cross section of the neck, which prevents the pin loop of the string from sliding off of the bowling pin. The pin arm loop of the string may be tightened by a player whereby it is secured to the pin end of the pin arm by friction. The frictional force between the strings and the pin arms may be strong enough to suspend the bowling pins above a playing surface. The frictional force between the strings and the pin arms may also be weak enough that the connection between the strings and the pin arms is broken when the bowling pins are struck by a bowling ball.

The bowling pins may alternatively be connected to the pin arms by use of claws configured at the pin ends of each pin arm. Each claw may have at least 3 claw arms that extend downwards from the pin end of the pin arm and around the pin arm end of the bowling pin. The ends of the claws may contact the bowling pin near the neck whereby the claw grasps the bowling pin. The claw arms may be pivoted by a player in order to configure the bowling pin between the claw arms. The claw arms may further be connected to springs that force the claw arms to rotate towards one another, thereby automatically grasping the bowling pin. The grasp of the claws around the bowling pins may be strong enough to suspend the bowling pins above a playing surface. The grasp of the claws around the bowling pins may also be weak enough that the bowling pins are released from the grasp of the claws when the bowling pins are struck by a bowling ball.

A ball catcher may be configured near the back ends of each of the feet of the frame. The ball catcher may have a front crossbar and a rear crossbar connected by a series of side poles. The front crossbar and rear crossbar may be configured parallel to an even playing surface. The front crossbar may be configured a further vertical distance away from the playing surface than the rear crossbar. Flaps may extend downwards from the front crossbar towards the playing surface. The flaps may contact the playing surface or may hang slightly above the playing surface. The flaps may be non-rigid sheets. The flaps may be made of a flexible material such as a rubber, silicone, or the like.

When a bowling ball rolls towards the ball catcher, the bowling ball may contact the flaps thereby creating frictional drag on the bowling ball thereby slowing the bowling ball. The force of the bowling ball against the flaps may cause the flaps to move in a manner that allows the bowling ball to pass underneath the front crossbar and beyond the flaps. If a bowling ball passes beyond the flaps of the ball catcher, the bowling ball may contact the rear crossbar. The rear crossbar may be a rigid member that may not allow the bowling ball to pass beyond the rear crossbar. The rear crossbar may absorb some of the force of the rolling bowling ball. The rear crossbar may further dissipate some of the force of the rolling ball. In this manner, the rear crossbar may serve and a spring-and-damper system with a spring constant and a damper constant. After contacting the rear crossbar, the reaction force of the crossbar may cause the bowling ball to be re-directed towards the flaps. In these scenarios, the flaps may contain the bowling ball within the ball catcher by serving as a barrier that absorbs and/or dissipates some of the force of the bowling ball. Because the bowling ball would be moving with a much lesser velocity when being re-directed towards the flaps than when the bowling ball rolls towards the ball catcher, the flaps would be able to stop the bowling ball when the bowling ball is re-directed towards the flaps, rather than allowing the bowling ball to pass beyond the flaps. In some embodiments, the flaps may touch the playing surface and may extend slightly back towards the rear crossbar, whereby when the bowling ball contact the flaps after contacting the rear crossbar, the flaps may serve as a ramp to direct the bowling ball up towards the front crossbar rather than beyond the flaps towards the frame.

In these manners, the flaps and the rear crossbar may allow the bowling ball to enter the ball catcher but may stop the bowling ball from exiting the ball catcher.

The various components of the frame such as the crossbar, frame posts, feet, angled bars, and pin arms, as well as the various components of the ball catcher such as the front crossbar, rear crossbar, and side poles, may be made of lightweight materials such as but not limited to polyethylene, polyvinyl chloride, polypropylene, and acrylonitrile butadiene styrene. The various components of the frame and of the ball catcher may be disassembled from one another for easy transportation and storage. The various components of the frame and ball catcher may be removably attached to one another by fastening mechanisms. Said fastening mechanisms may be but are not limited to threads, press fits, pin-and-hole systems, and snap systems.

Pin-and-hole systems may include holes at the ends of two members that are aligned, and pin that is inserted through said holes to secure the two members together. Snap systems may include bendable arms of a first member that are inserted into receiving ports of a second member whereby the bendable arms are deformed before entering the receiving ports. The bendable arms may be allowed to expand within the receiving ports in order to secure the first member to the second member. The "members" described herein may be one or more of the various components of the frame or ball catcher of the portable bowling system.

A bowling ball of the portable bowling system may have one thumb hole and a plurality of finger holes. The finger holes may be different sizes. There may be two of each size of finger hole thereby forming multiple pairs of finger holes. The pairs of finger holes may be arranged in a pattern around the bowling ball. The pattern may be a 2-dimensional curve containing one or more radii of curvature. The pattern may further be a portion of a circle. The pattern may further be a full circle. The pattern may alternatively be a 3-dimensional curve containing one or more radii of curvature. The pattern may further be a helix.

The finger holes may be sized appropriately for the fingers of statistically significant subsets of a population. Said statistically significant subsets may be assigned qualitative size values such as but not limited to "extra small", "small", "medium", "large", "extra large", and "extra extra large". An extra small finger hole may have a diameter of 0.675" or less. A small finger hole may have a diameter within the range of 0.65"-0.77", inclusive of the values provided. A medium finger hole may have a diameter within the range of 0.72"-0.85", inclusive of the values provided. A large finger hole may have a diameter within the range of 0.82"-0.9", inclusive of the values provided. An extra large finger hole may have a diameter within the range of 0.85"-0.95", inclusive of the values provided. An extra extra large finger hole may have a diameter of 0.9" or greater.

Smaller finger holes may be positioned closer to the thumb hole than larger holes. For example, the two extra small finger holes may be positioned the closest distance to the thumb hole, said distance being measured from the center of each finger hole to the center of the thumb hole. Likewise, the two extra extra large finger holes may be positioned the furthest distance to the thumb hole, said distance being measured from the center of each finger hole to the center of the thumb hole.

The various sizes of finger holes and the various distances of finger holes from the thumb hole allow players with various sizes of hands to use the same bowling ball. This negates the need for multiple bowling balls and creates a more efficient, cost-effective, portable, and stowable bowling system. The bowling ball may be made of traditional bowling ball materials such as a powdered metal oxide covered with a hard plastic. Alternatively, the bowling ball may be made of a lightweight plastic material to allow the bowling ball to be portable and easily used by players of low physical strength such as children. The bowling ball may be made of a rubber, a foam, or an EVA foam. EVA foam is also known as ethylene-vinyl acetate. In the embodiments wherein the bowling ball is made of a rubber, foam, or EVA foam, the bowling ball may be lightweight to allow the bowling ball to be portable and easily used by players of low physical strength. The bowling ball may be solid or hollow.

The frame and ball catcher of the portable bowling system may be configured on the playing surface whereby the frame is configured between the ball catcher and a player. The player may roll the bowling ball towards the frame whereby the bowling ball contacts at least some of the bowling pins, causing the at least some of the bowling pins to be detached from their respective pin arms and fall to the playing surface. The bowling ball may contact the flaps of the ball catcher, wherein the flaps of the ball catcher create frictional drag on the bowling ball, whereby the bowling ball is slowed by the flaps. The flaps may allow the bowling ball to pass beyond the flaps and be trapped by the ball catcher.

The playing surface on which the frame and ball catcher are configured may be indoors or outdoors. The playing surface may be an even playing surface or an uneven playing surface regardless of whether the playing surface is indoors or outdoors. The playing surface may have grass, which may cause the playing surface to be an uneven playing surface. Playing surfaces with grass may necessitate rotating the foot ends of the frame (described further herein) in order to raise the frame further from the surface.

The present invention further relates to a method of use of the portable bowling system described herein. The frame may be provided and assembled on an even or uneven playing surface. The bowling pins may be removably attached to the pin arms whereby the bowling pins hang above the playing surface. The ball catcher may be provided and assembled on the playing surface behind the frame, whereby the frame is configured between a first player and the ball catcher. The first player may grasp the bowling ball by inserting the first player's thumb into the thumb hole and two of the first player's fingers into two of the finger holes. The first player may roll the bowling ball towards the pins. The bowling ball may contact one or more of the pins, causing said one or more of the bowling pins to become detached from the pin arms and fall to the playing surface.

The bowling ball may pass beyond the frame and contact one or more of the flaps of the ball catcher. The bowling ball may pass beyond the one or more flaps of the ball catcher and contact the rear crossbar of the ball catcher. The bowling ball may stop after contacting the rear crossbar of the ball catcher. The bowling ball may be retrieved. The bowling pins may be re-attached to the pin arms.

A second player may grasp the bowling ball by inserting the second player's thumb into the thumb hole and two of the second player's fingers into two of the finger holes. The second player may roll the bowling ball towards the pins. The bowling ball may contact one or more of the pins, causing said one or more of the bowling pins to become detached from the pin arms and fall to the playing surface. The bowling ball may pass beyond the frame and contact one or more of the flaps of the ball catcher. The bowling ball may pass beyond the one or more flaps of the ball catcher and contact the rear crossbar of the ball catcher. The bowling ball may stop after contacting the rear crossbar of the ball catcher.

The method may be performed by any number of players. A third player, fourth player, fifth player, etc. may also grasp the bowling ball and roll the bowling ball towards the pins. The players may keep score by counting the number of bowling pins that each player causes to be disconnected from the pin arms by use of the bowling ball.

The term "beyond the flaps" as used herein refers to the bowling ball crossing a plane on which the flaps are configured. Therefore, the bowling ball may go "beyond the flaps" when entering the ball catcher, and may also go "beyond the flaps" if exiting the ball catcher.

DETAILED DESCRIPTION

The description provided herein describes example embodiments of the present invention and is not intended to limit the invention to any particular embodiment, feature, component, design, size, shape, method, or any other property. Furthermore, the figures provided herein show example embodiments of the present invention and are not intended to limit the invention to any particular embodiment, feature, component, design, shape, size, method, or any other property. The term "connected" as used herein may mean both permanently connected and removably connected. The term "rolled" as used herein to describe the motion of a bowling ball may have the common meaning of "rolled", "thrown", "slid", or combinations of two or more of said terms. It shall be noted that said terms may be used in other tenses (ex: "roll", "rolling", etc.) that shall not alter the general meaning of said terms.

Figure 1:
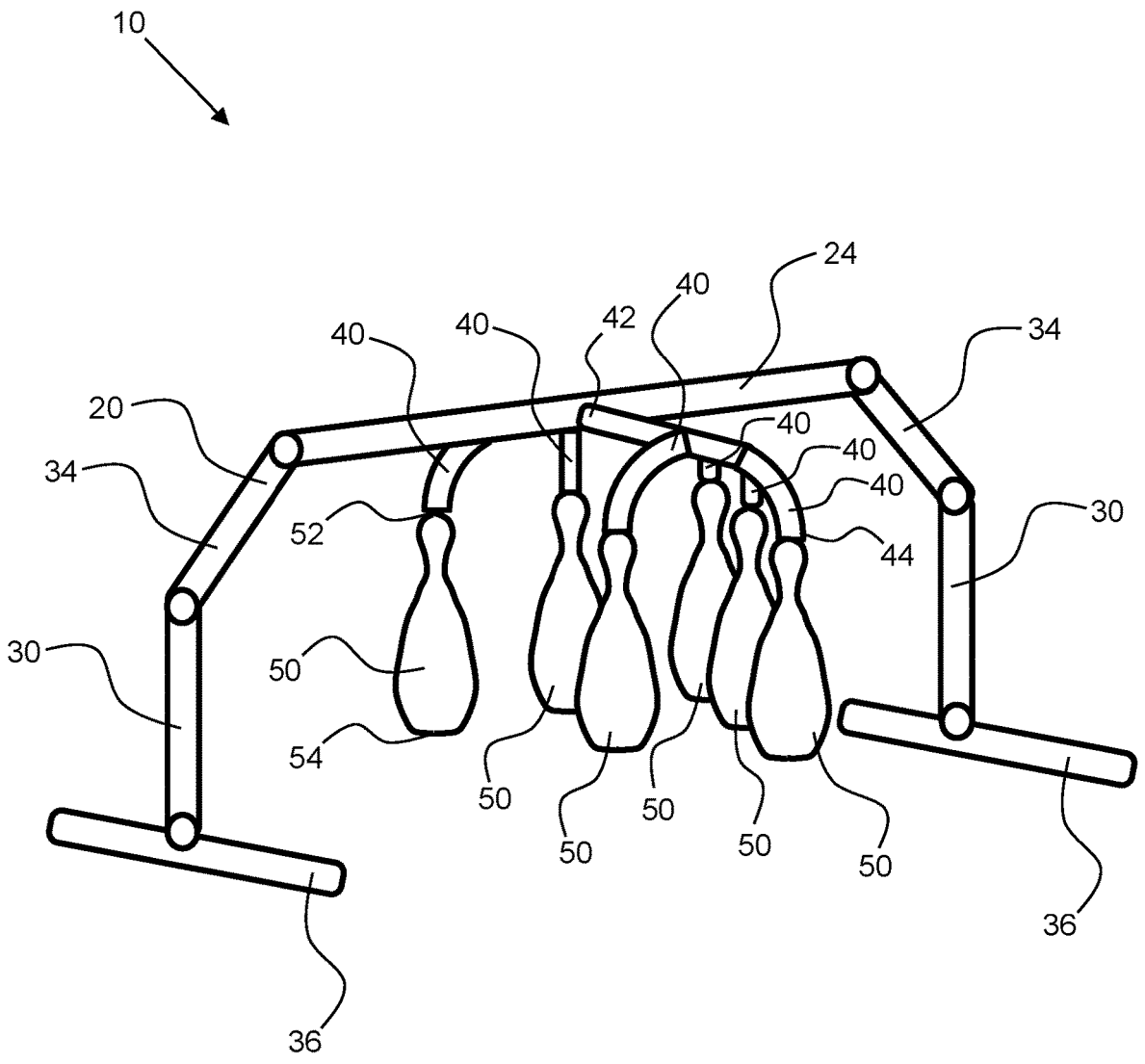
FIG. 1 is a front right perspective view of a frame of a portable bowling system.

As shown in FIG. 1, a frame 20 of a portable bowling system 10 has a crossbar 24 connected to two angled bars 34, with one angled bar 34 being connected at each end of the crossbar 24. Each angled bar 34 is also connected to a frame post 30. Each frame post is connected to a foot 36. Pin arms 40 extend from the crossbar 24. Each pin arm 40 has a crossbar end 42 that connects to the crossbar 24, and a pin end 44 that connects to a bowling pin 50. There is one bowling pin 50 for each pin arm 40. A total of six bowling pins 50 and six pin arms 40 are shown in FIG. 1. Each bowling pin 50 has a pin arm end 52 that connects to the pin end 44 of its respective pin arm 40. Each bowling pin 50 has a hanging end 54 opposite its pin arm end 52. The hanging end 54 of each bowling pin 50 hangs above a playing surface (not shown in FIG. 1).

Figure 2:
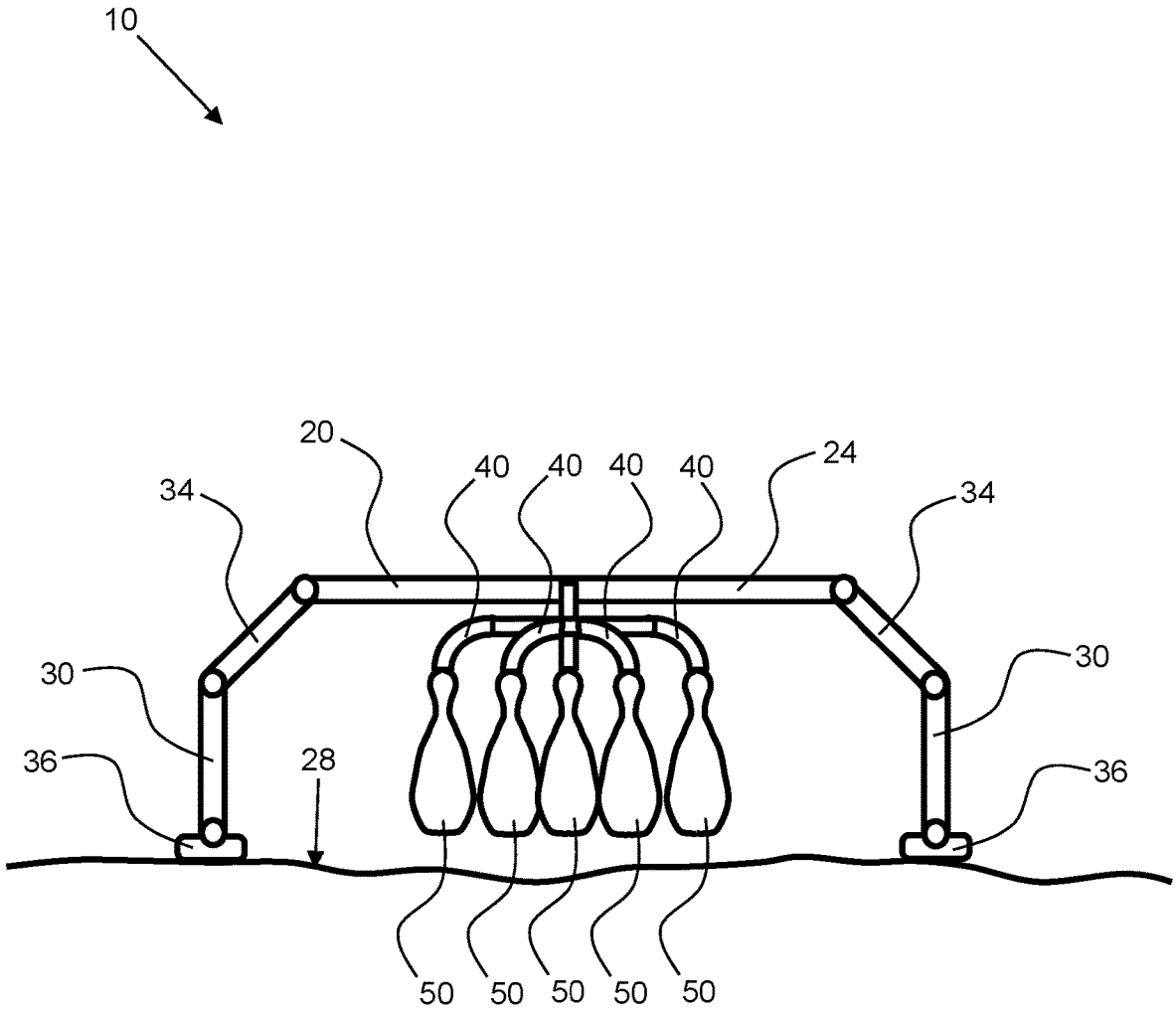
FIG. 2 is a front view of a frame of a portable bowling system.
Figure 4:
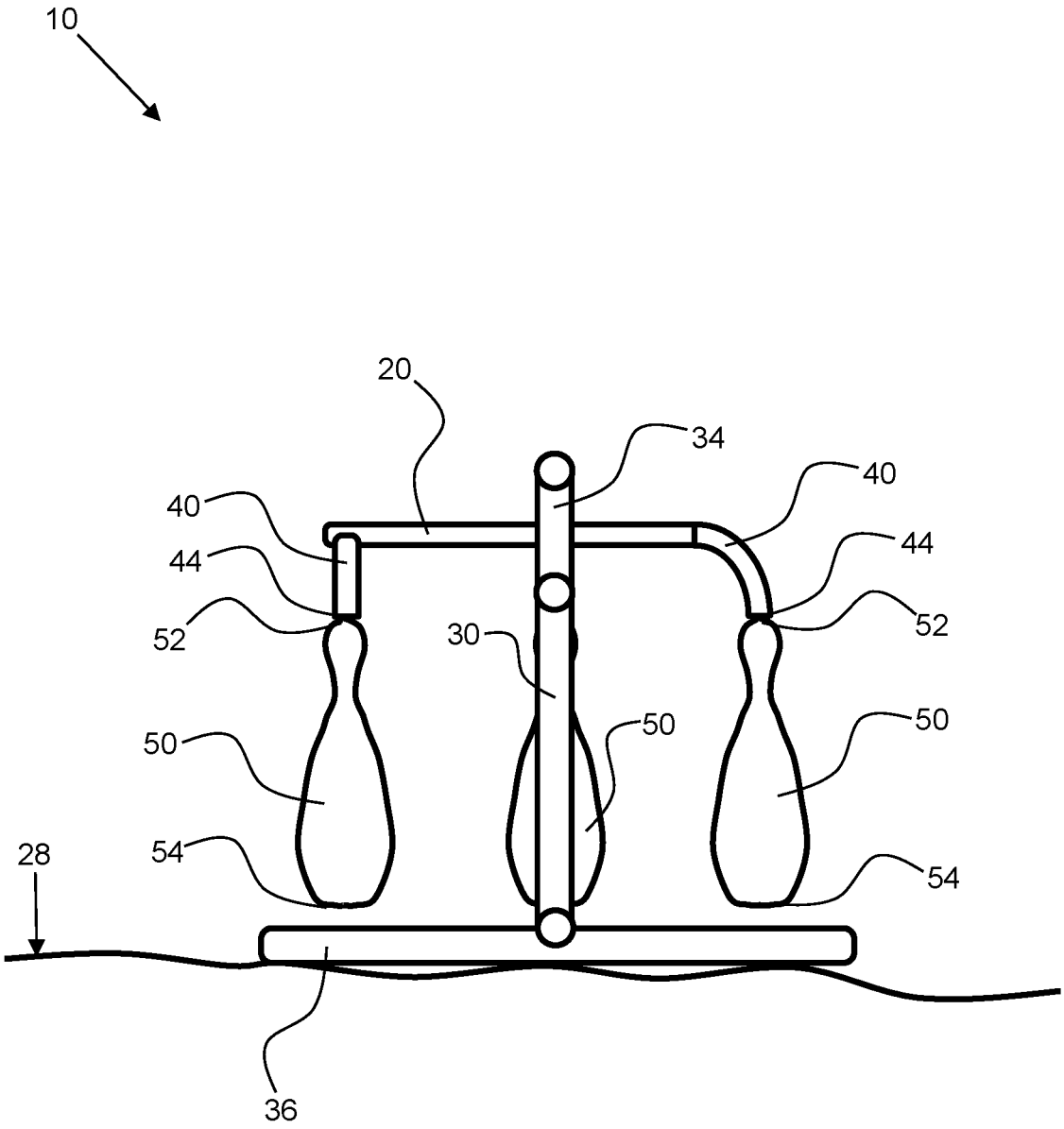
FIG. 4 is a right-side view of a frame of a portable bowling system.

As shown in FIGS. 2 and 4, the feet 36 of the frame 20 are configured on a playing surface 28 whereby the rest of the frame 20 and the bowling pins 50 are configured above the playing surface 28. The playing surface 28 shown in FIGS. 2 and 4 is an uneven playing surface.

Figure 3:
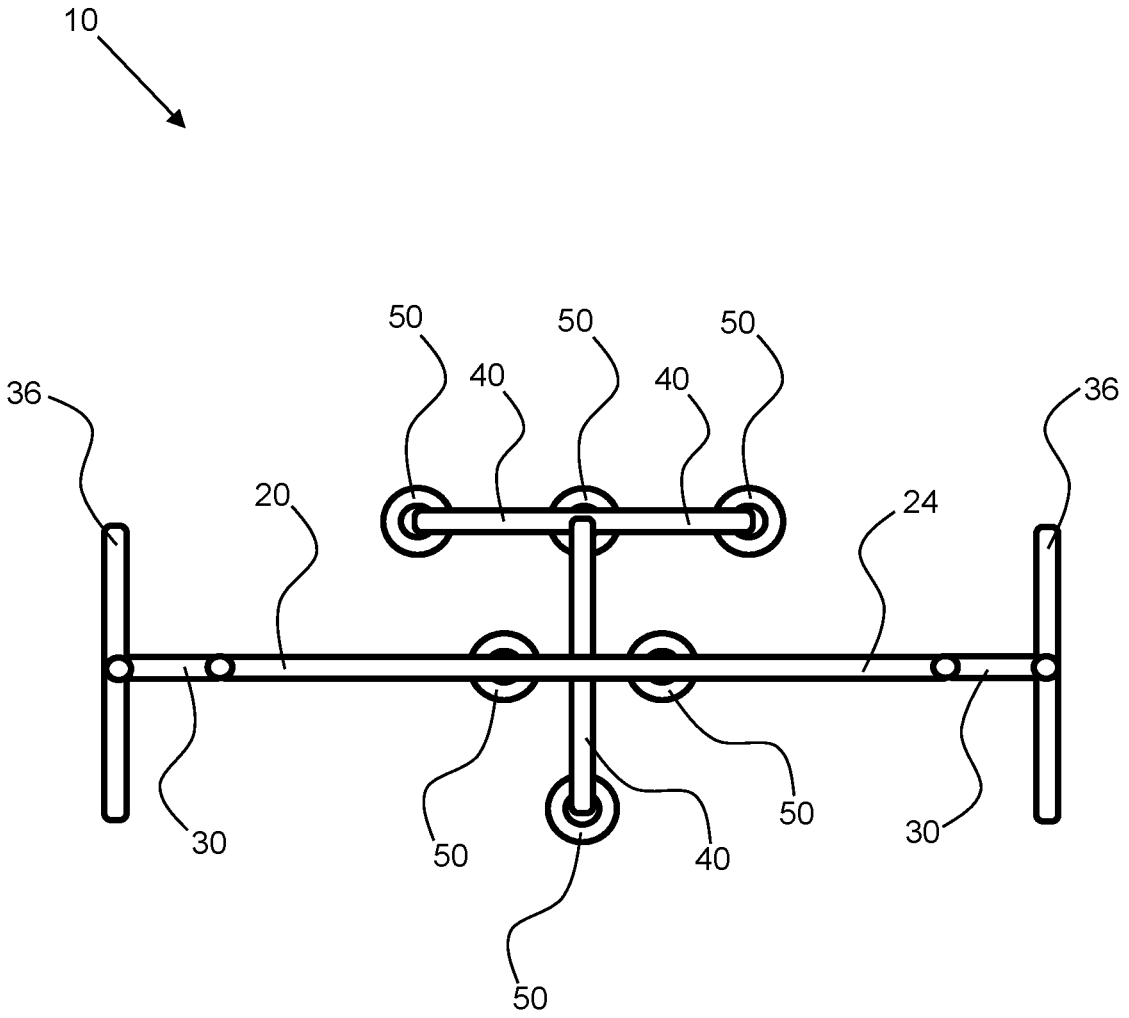
FIG. 3 is a top view of a frame of a portable bowling system.

As shown in FIG. 3, six bowling pins 50 are arranged in a triangular pattern when suspended from the pin arms 40. In this triangular pattern, one bowling pin 50 is configured at the front of the pattern, two bowling pins 50 are configured in the middle of the pattern, and three bowling pins 50 are configured at the back of the pattern.

Figure 5:
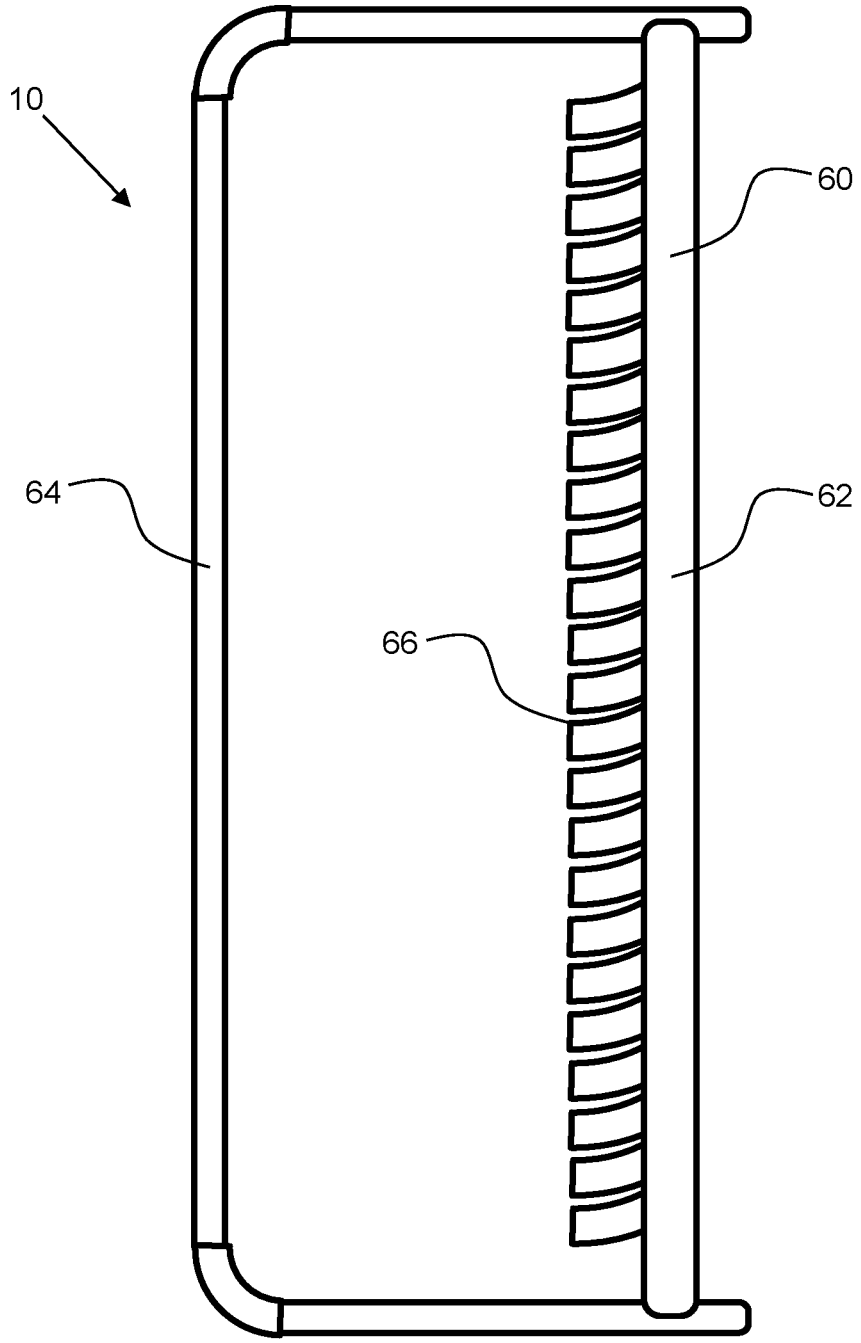
FIG. 5 is a top view of a ball catcher of a portable bowling system.
Figure 6:
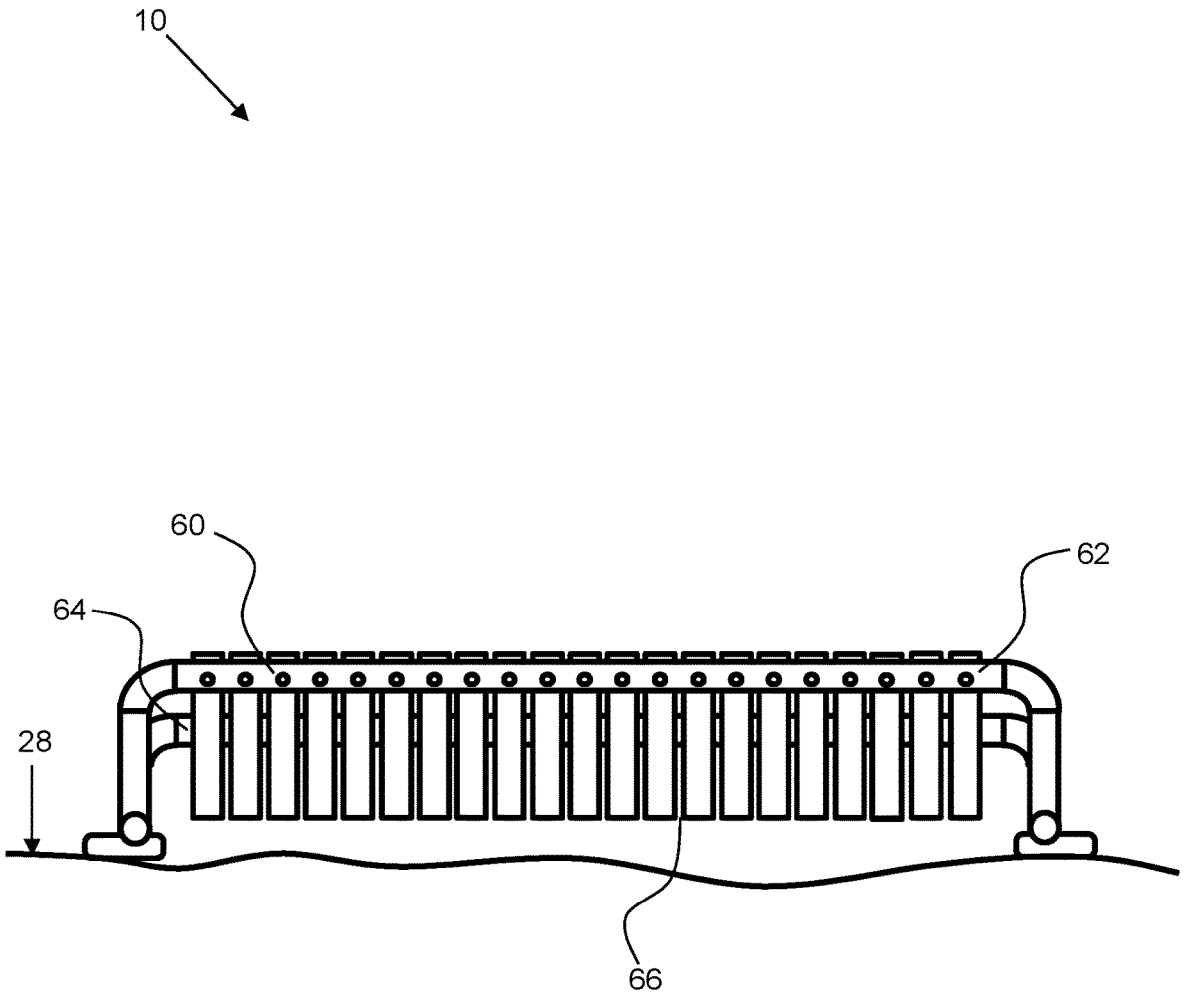
FIG. 6 is a front view of a ball catcher of a portable bowling system.
Figure 7:
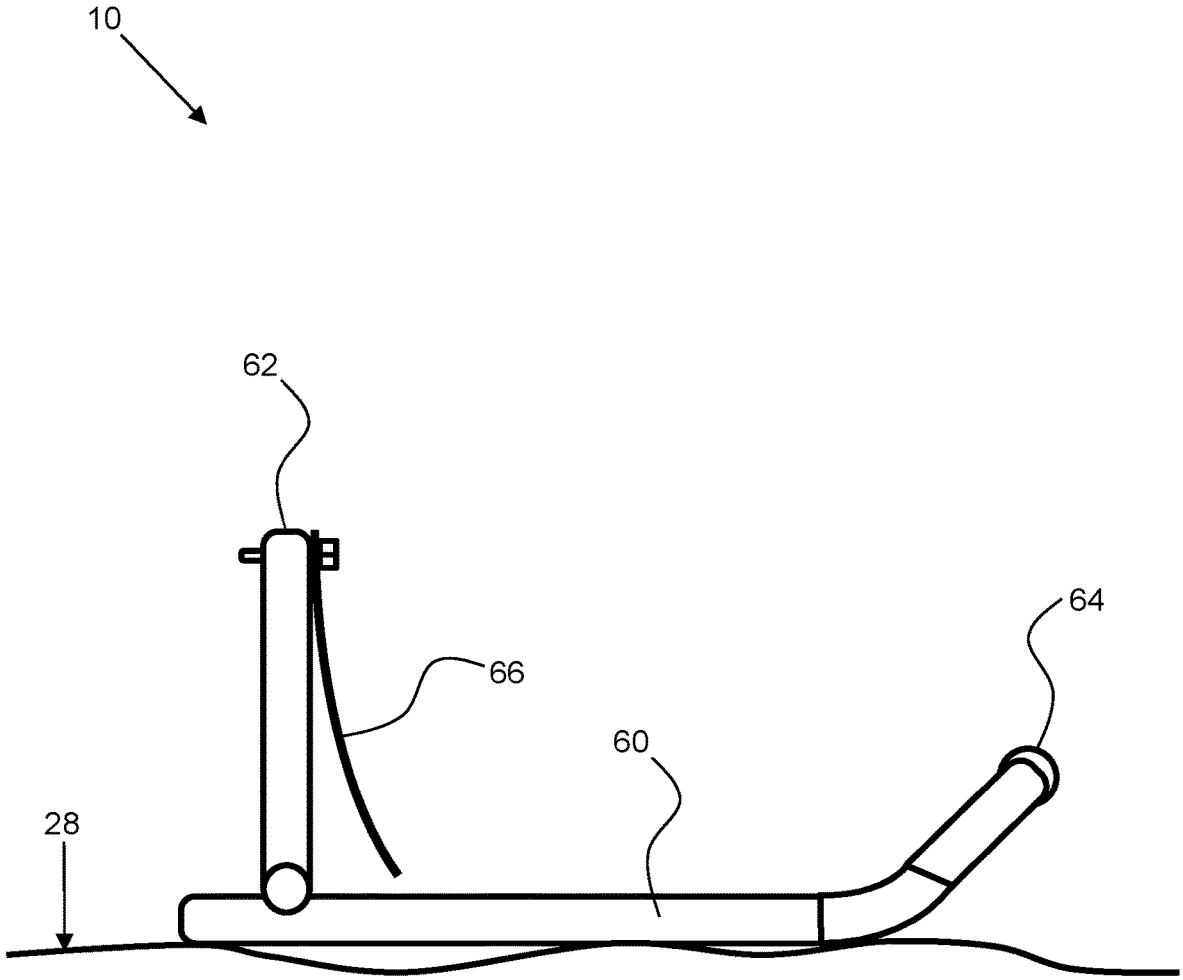
FIG. 7 is a left-side view of a ball catcher of a portable bowling system.

As shown in FIGS. 5-7, a ball catcher 60 has a front crossbar 62 and a rear crossbar 64 that are configured parallel to one another. Flaps 66 extend from the front crossbar 62 towards the playing surface 28. The playing surface 28 shown in FIGS. 6-7 is an uneven playing surface (no playing surface is shown in FIG. 5). The flaps 66 may extend towards the rear crossbar 64 when an external force such as that of a rolling bowling ball contacts the flaps 66 and forces them to extend towards the rear crossbar 64.

Figure 8:
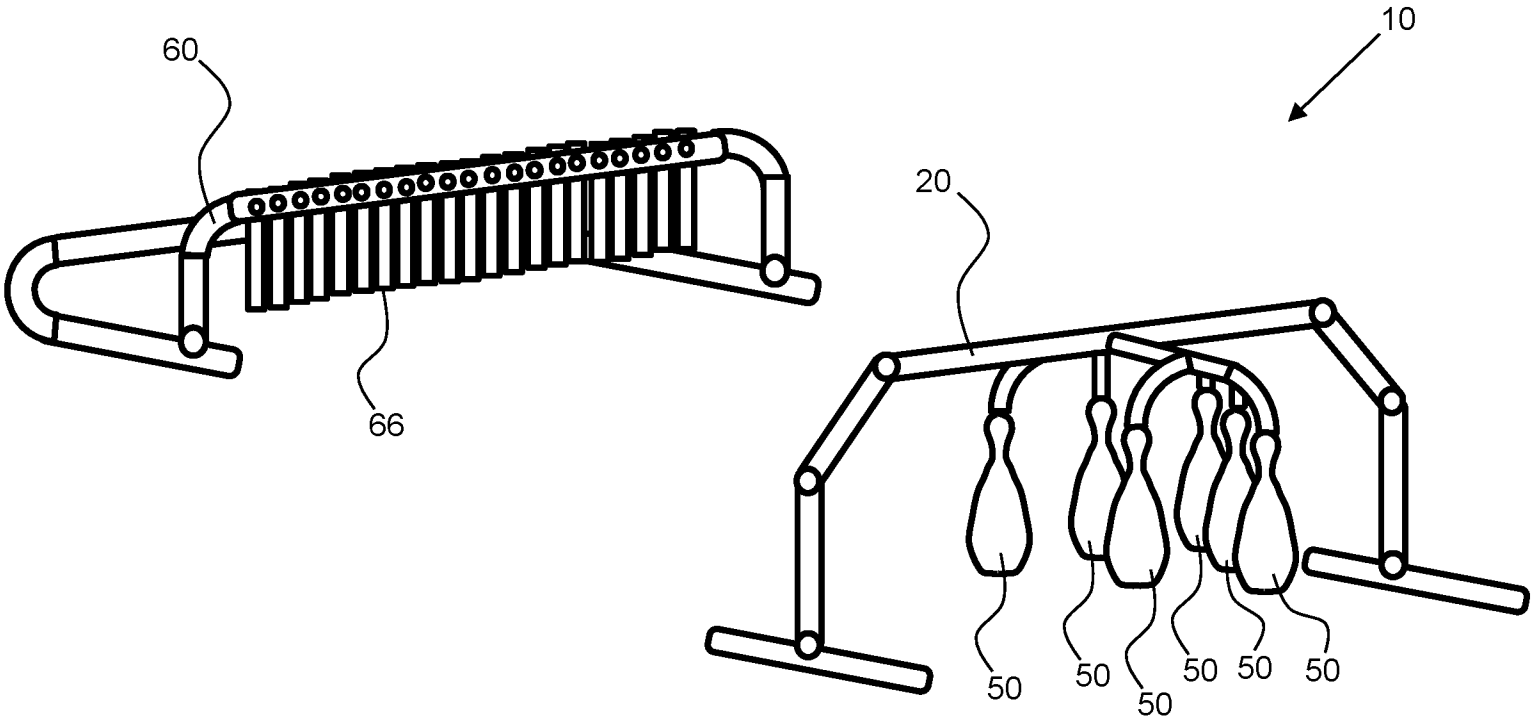
FIG. 8 is a front right perspective view of a frame of portable bowling system configured in front of a ball catcher of a portable bowling system.

As shown in FIG. 8, the frame 20 of the portable bowling system 10 is configured in front of the ball catcher 60. In this configuration, a bowling ball (not shown in FIG. 8) may be rolled towards the frame 20 and may contact one or more of the bowling pins 50. The bowling ball may then roll beyond the frame 20 to the ball catcher 60. The bowling ball may contact one or more of the flaps 66 of the ball catcher 60.

Figure 9:
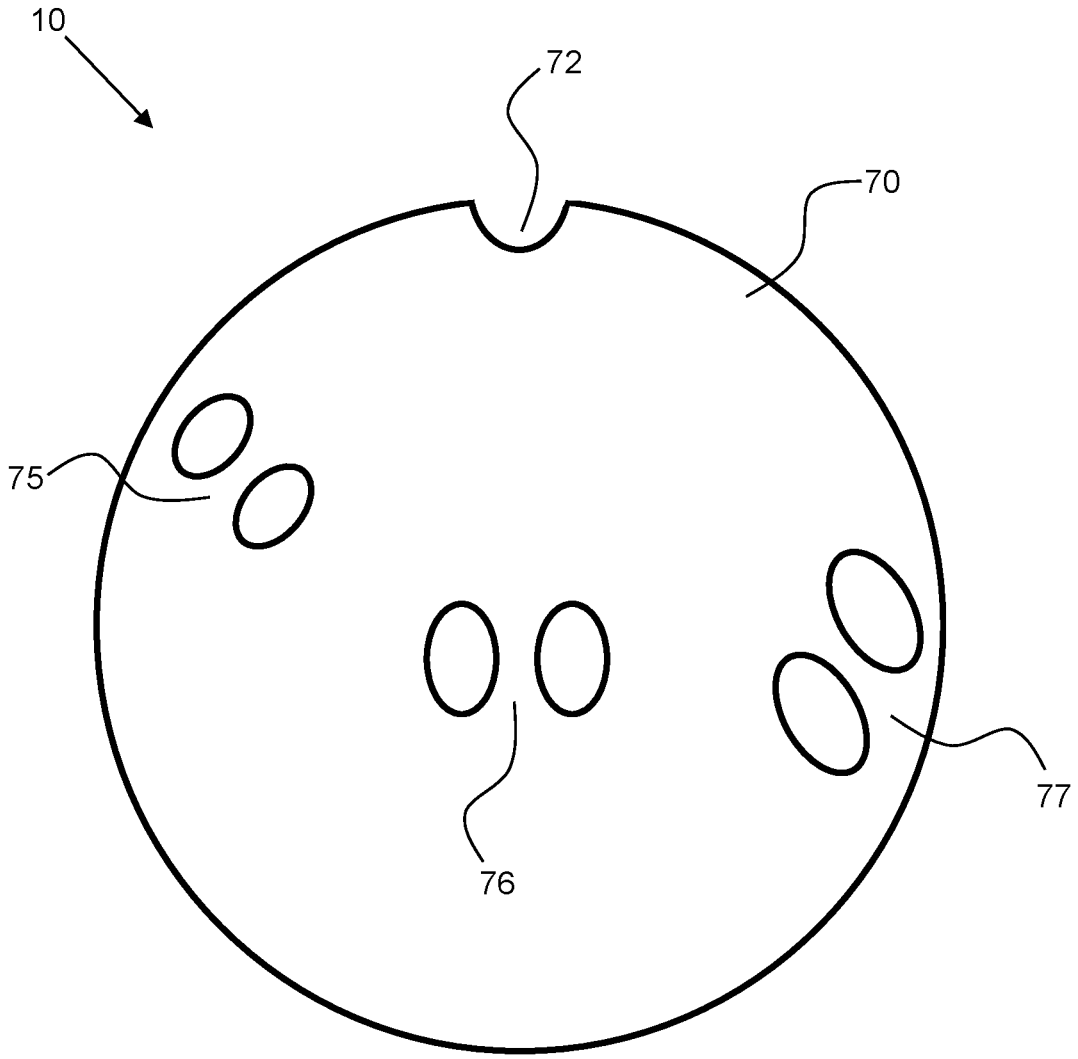
FIG. 9 is a front view of a bowling ball of a portable bowling system.
Figure 10:
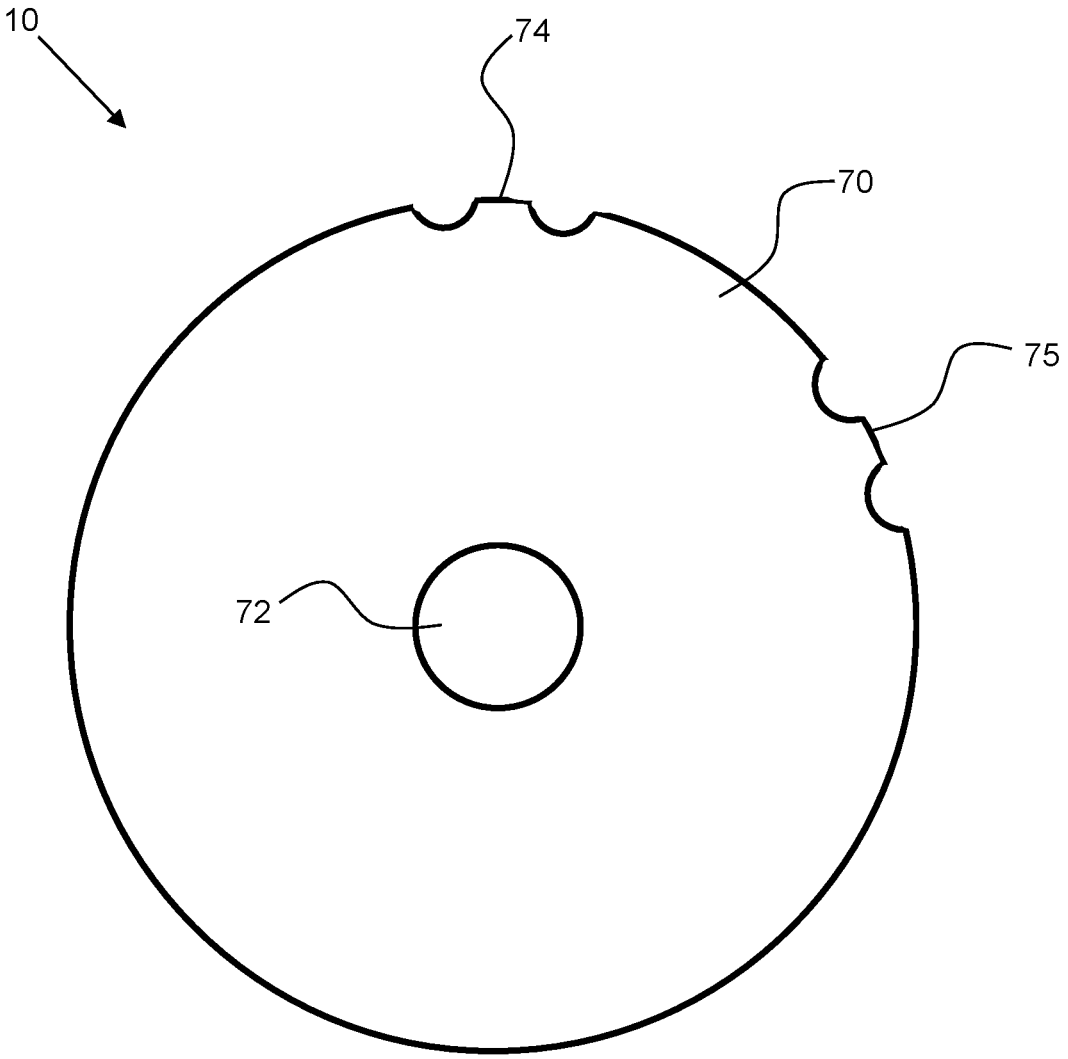
FIG. 10 is a top view of a bowling ball of a portable bowling system.
Figure 11:
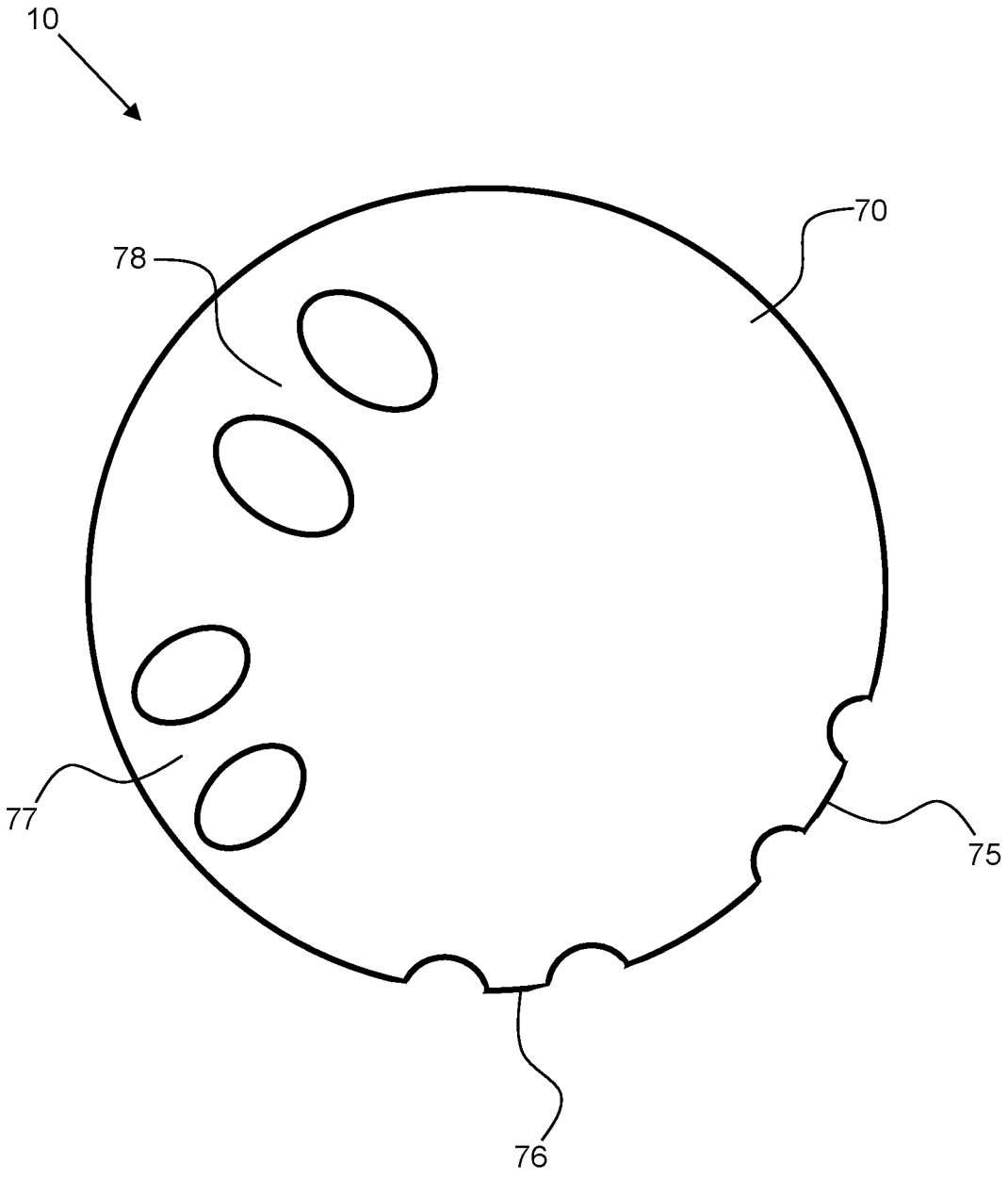
FIG. 11 is a bottom view of a bowling ball of a portable bowling system.

As shown in FIGS. 9-11, a bowling ball 70 of a portable bowling system 10 has a thumb hole 72 and pairs of finger holes arranged in a pattern around the bowling ball 70. The pairs of finger holes are a pair of extra small finger holes 74, a pair of small finger holes 75, a pair of medium finger holes 76, a pair of large finger holes 77, and a pair of extra large finger holes 78. The extra small finger holes 74 are configured closest to the thumb hole 72, and the extra large finer holes 78 are configured furthest from the thumb hole 72. The small finger holes 75 are larger than the extra small finger holes 74 and smaller than the medium finger holes 76. The medium finger holes 76 are smaller than the large finger holes 77. The large finger holes are smaller than the extra large finger holes 78. The thumb hole 72 may be the largest of all the holes in the bowling ball 70.

Figure 12:
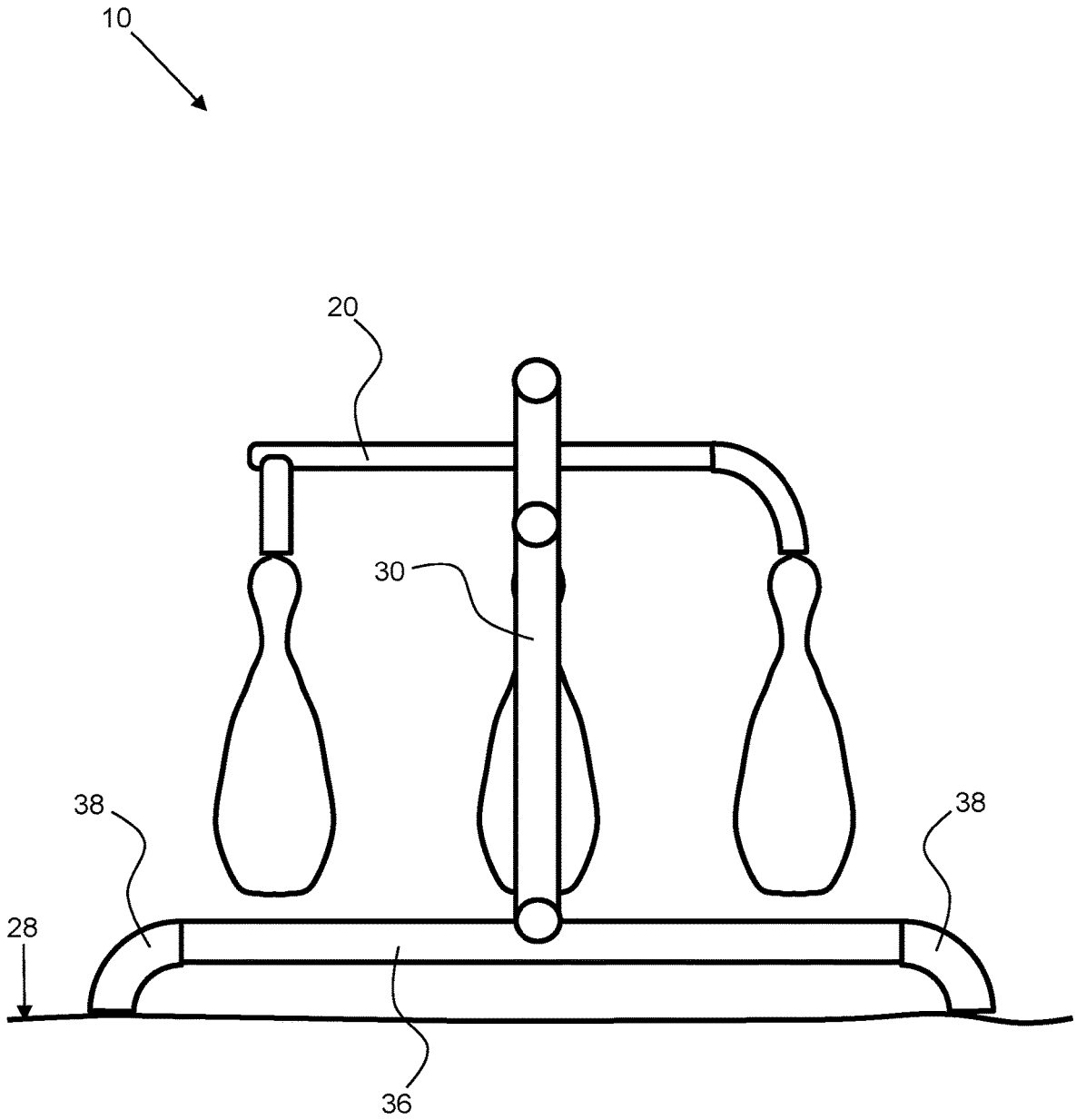
FIG. 12 is a side view of a frame of a portable bowling system wherein foot ends of the frame are rotated 0 degrees about their respective feet.
Figure 13:
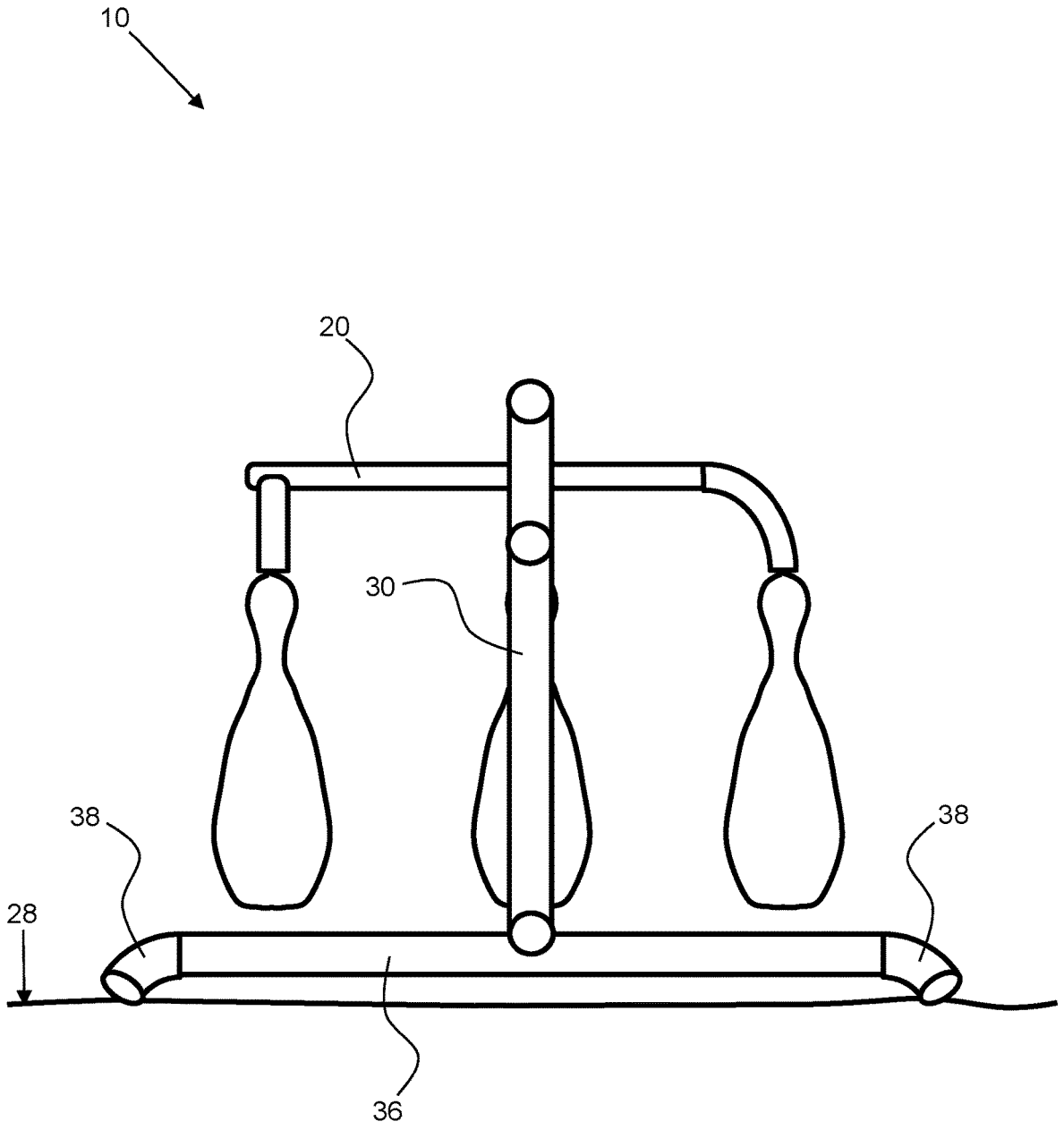
FIG. 13 is a side view of a frame of a portable bowling system wherein foot ends of the frame are rotated 45 degrees about their respective feet.
Figure 14:
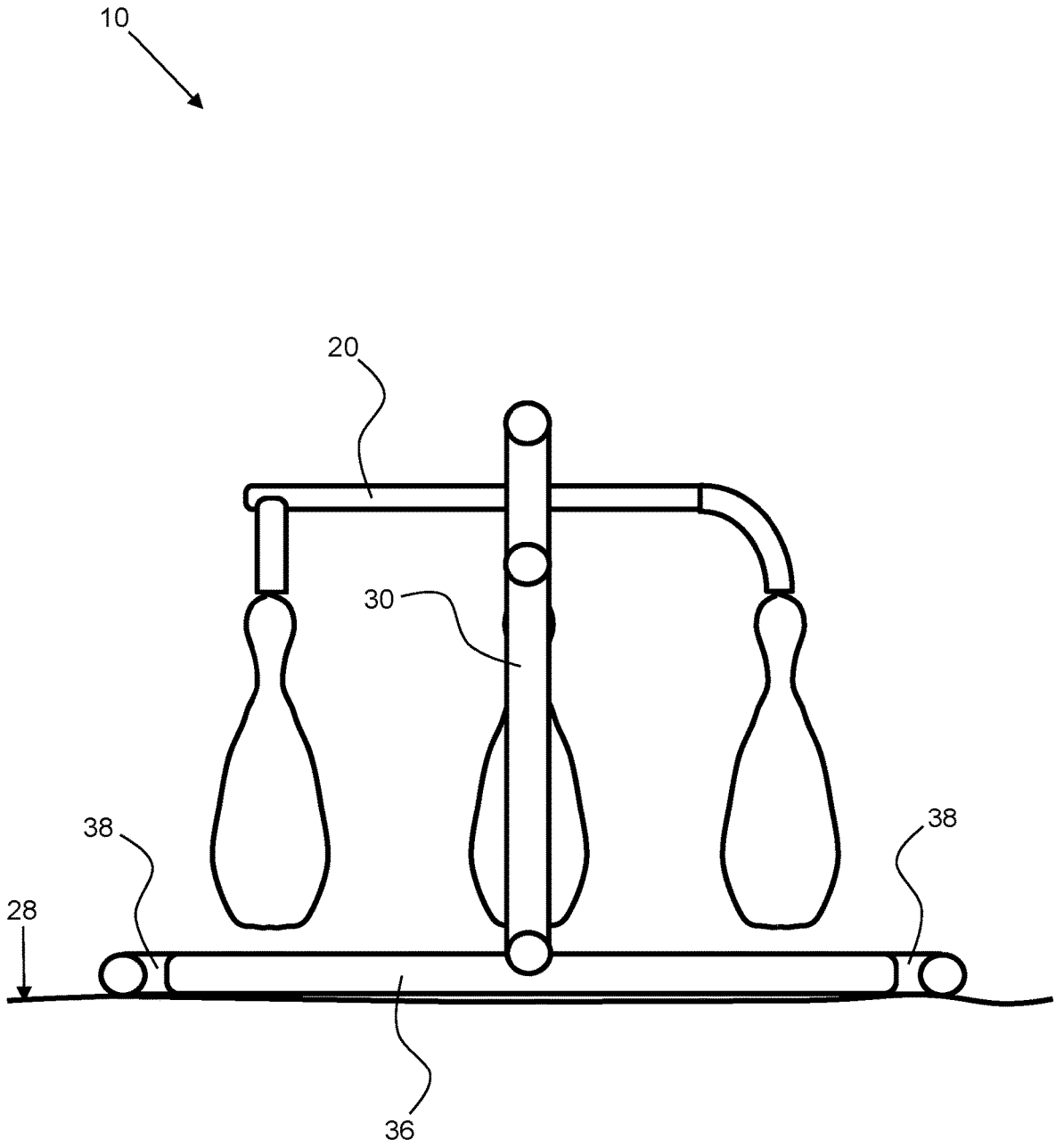
FIG. 14 is a side view of a frame of a portable bowling system wherein foot ends of the frame are rotated 90 degrees about their respective feet.
Figure 15:
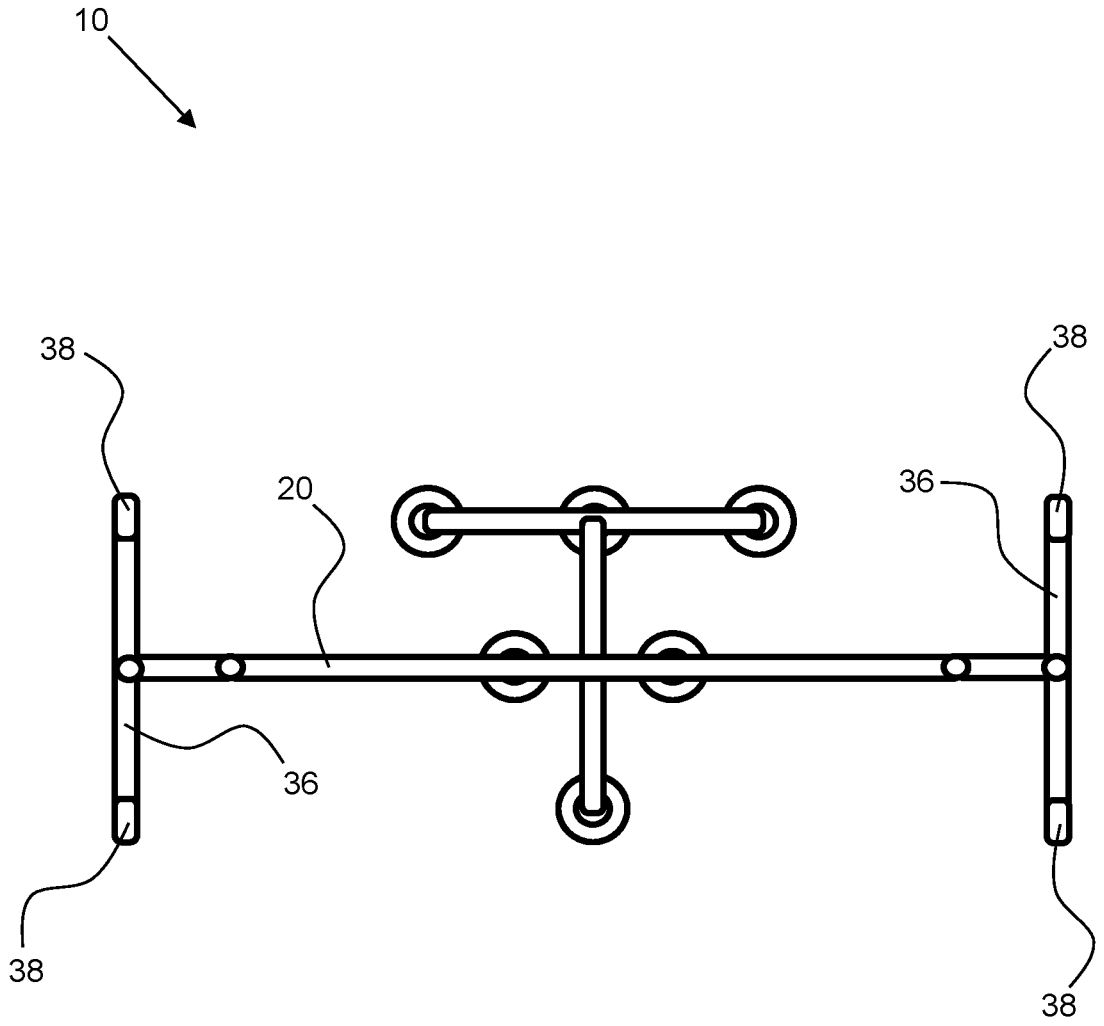
FIG. 15 is a top view of a frame of a portable bowling system wherein foot ends of the frame are rotated 0 degrees about their respective feet.

As shown in FIGS. 12-17, each foot 36 of the frame 20 has two foot ends 38. Each foot end 38 may have a curved or angled shape. The foot ends 38 may rotate about their respective feet 36. As shown in FIGS. 12 and 15, the foot ends 38 are rotated 0 degrees about their respective feet 36 whereby the frame 20 is raised from the playing surface 28. This may be useful when protrusions such as grass extend from the playing surface. Only the foot ends 38 of the feet 36 contact the playing surface 28 when the foot ends 38 are rotated 0 degrees about their respective feet 36.

Figure 16:
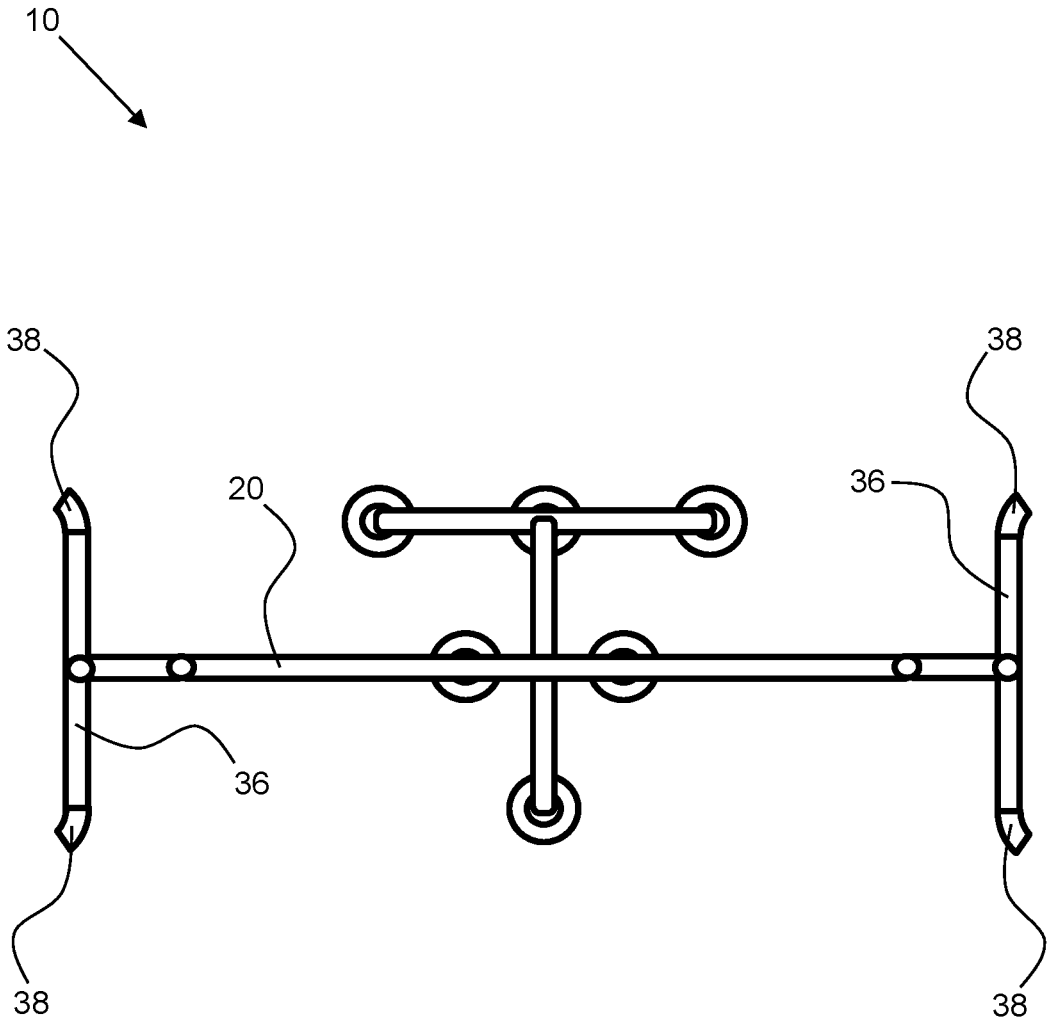
FIG. 16 is a top view of a frame of a portable bowling system wherein foot ends of the frame are rotated 45 degrees about their respective feet.

As shown in FIGS. 13 and 16, the food ends 38 are rotated 45 degrees about their respective feet 36 whereby the frame 20 is still raised above the playing surface 28, but less so than when the foot ends 38 are rotated 0 degrees about their respective feet 36. This may allow for greater stability of the frame 20 against the playing surface 28. Only the foot ends 38 of the feet 36 touch the playing surface 28 when the foot ends 38 are rotated 45 degrees about their respective feet 36.

Figure 17:
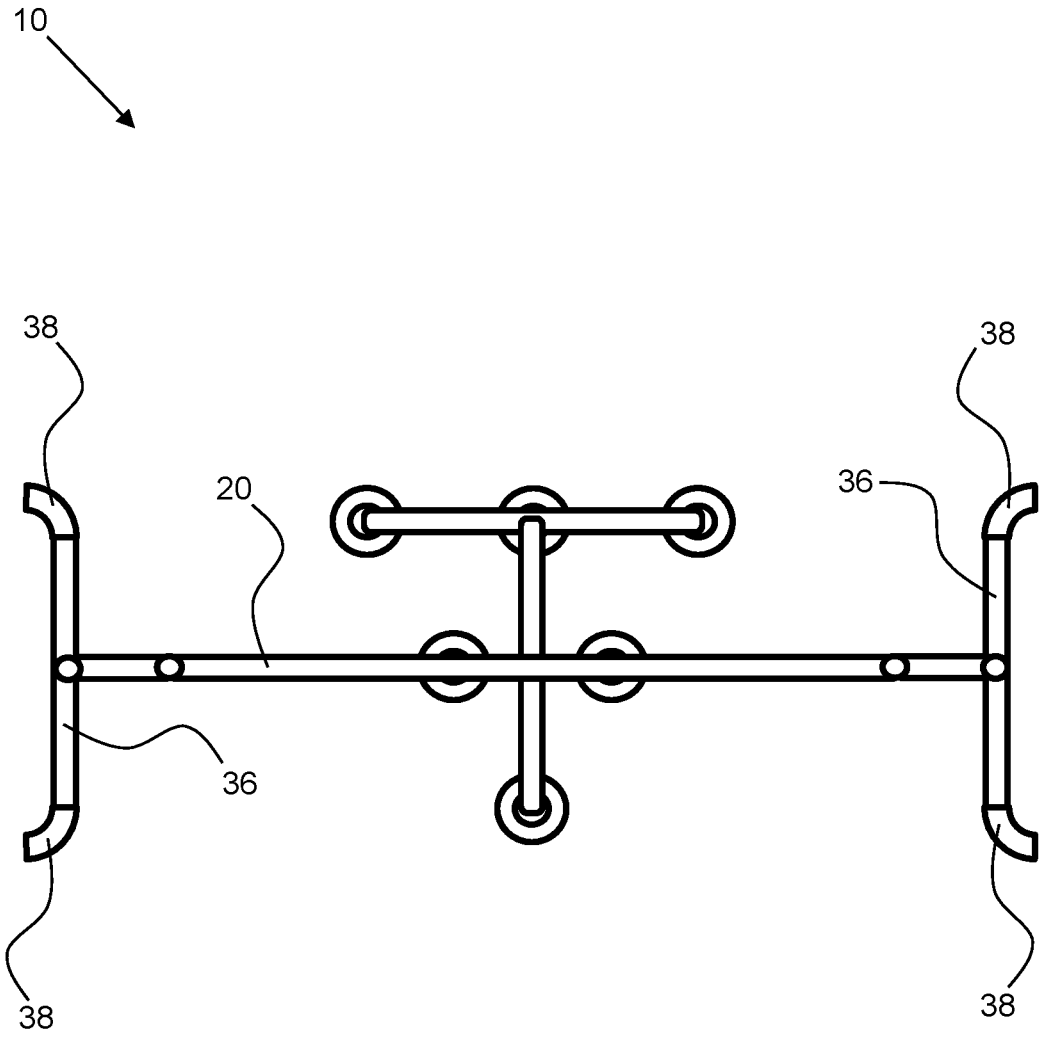
FIG. 17 is a top view of a frame of a portable bowling system wherein foot ends of the frame are rotated 90 degrees about their respective feet.

As shown in FIGS. 14 and 17, the foot ends 38 are rotated 90 degrees about their respective feet 36 whereby a large portion of each foot 36 contacts the playing surface 28. If the playing surface 28 is an even playing surface, then the entirety of each foot 36 may contact the playing surface 28 when the foot ends 38 are rotated 90 degrees about their respective feet 36. This may allow for the greatest stability between the frame 20 and the playing surface 28.

In addition to the angles described above, the foot ends may be configure to rotate at any angle about their respective feet. Furthermore, each foot end may rotate independently. Therefore, it is possible that all 4 foot ends of the frame be rotated at different angles about their respective feet. By rotating about their respective feet, the foot ends may cause the frame to be adjusted vertically relative to the playing surface.

What is claimed is:

1. A portable bowling system comprising:

a frame comprising:

a crossbar;

two frame posts connected to the crossbar;

two feet, each foot being connected to a frame post;

pin arms extending from the crossbar;

bowling pins removably connected to the pin arms, whereby one bowling pin is removably connected to each pin arm;

a ball catcher comprising:

a front crossbar;

a rear crossbar;

flaps extending from the front crossbar; and a bowling ball, wherein the frame and ball catcher are configured on a playing surface whereby the bowling pins hang above the playing surface when removably connected to the pin arms, wherein the frame is configured between the ball catcher and a player, wherein the player rolls the bowling ball towards the frame whereby the bowling ball contacts at least some of the bowling pins, whereby the at least some of the bowling pins are detached from their respective pin arms and fall to the playing surface, wherein the bowling ball contacts the flaps of the ball catcher, wherein the flaps of the ball catcher create frictional drag on the bowling ball whereby the bowling ball is slowed by the flaps, and wherein the flaps move to allow the bowling ball to pass beyond the flaps.

2. The portable bowling system of claim 1, wherein the flaps are flexible sheets.

3. The portable bowling system of claim 1, wherein the rear crossbar and the flaps contain the bowling ball within the ball catcher after the bowling ball passes beyond the flaps.

4. The portable bowling system of claim 1, wherein the frame posts are connected to the crossbar by angled bars, wherein one angled bar is configured between each frame post and the crossbar, whereby one end of each angled bar is connected to a corresponding end of a corresponding frame post, and whereby an opposite end of each angled bar is connected to a corresponding end of the crossbar.

5. The portable bowling system of claim 1, wherein the playing surface is an even playing surface.

6. The portable bowling system of claim 1, wherein the playing surface is an uneven playing surface.

7. The portable bowling system of claim 1, wherein the number of bowling pins is 3 or more.

8. The portable bowling system of claim 1, wherein the number of bowling pins is 6 or more.

9. The portable bowling system of claim 1, wherein the number of bowling pins is 10 or more.

10. The portable bowling system of claim 1, further comprising two foot ends configured on each foot, wherein connections between each foot end and its corresponding foot are that of concentric cylinders, wherein each foot end is configured to rotate about its respective foot independently of the other foot ends, and wherein rotating the foot ends about their respective feet causes the frame to be adjusted vertically relative to the playing surface.

11. The portable bowling system of claim 1, wherein each pin arm comprises:

a crossbar end connected to the crossbar; and a pin end removably connected to a bowling pin, and wherein each bowling pin comprises:

a pin arm end removably connected to the pin end of its respective pin arm; and a hanging end that hangs above the playing surface when the bowling pin is removably connected to its respective pin arm.

12. The portable bowling system of claim 11, wherein a pin magnet is configured within the pin arm end of each bowling pin, wherein a pin arm magnet is configured within the pin end of each pin arm, wherein the pin magnets and pin arm magnets are of opposite polarity, wherein the pin arm end of each bowling pin contacts the pin end of a pin arm to removably connect a bowling pin to each pin arm.

13. The portable bowling system of claim 11, wherein a suction cup is configured at the pin end of each pin arm, wherein the pin arm end of each bowling pin contacts the suction cup of each pin arm to removably connect a bowling pin to each pin arm.

14. The portable bowling system of claim 1, wherein the bowling ball comprises:

a thumb hole; and pairs of finger holes arranged in a pattern around the bowling ball.

15. The portable bowling system of claim 14, wherein the pairs of finger holes comprise:

a pair of small finger holes a pair of medium finger holes; and a pair of large finger holes, wherein the medium finger holes are larger than the small finger holes, and wherein the large finger holes are larger than the medium finger holes.

16. The portable bowling system of claim 15, wherein the small finger holes each have a diameter in the range of 0.65 in-0.77 in, inclusive of said values, wherein the medium finger holes each have a diameter in the range of 0.72 in-0.85 in, inclusive of said values, and wherein the large finger holes each have a diameter in the range of 0.82 in-0.9 in, inclusive of said values.

17. The portable bowling system of claim 15, further comprising:

a pair of extra small finger holes; and a pair of extra large finger holes, wherein the extra small finger holes are smaller than the small finger holes, and wherein the extra large finger holes are larger than the large finger holes.

18. The portable bowling system of claim 17, wherein the extra small finger holes each have a diameter of 0.675 in or less, and wherein the extra large finger holes each have a diameter in the range of 0.85 in-0.95 in, inclusive of said values.

19. A method of playing a bowling game, comprising:

providing bowling pins;

providing a means for hanging the bowling pins above a playing surface;

configuring the bowling pins whereby the bowling pins hang above the playing surface;

providing a bowling ball;

providing a means for retaining the bowling ball after the bowling ball is rolled;

providing a first player;

providing a second player;

the first player rolling the bowling ball towards the bowling pins, whereby the bowling ball contacts one or more of the bowling pins whereby said one or more of the bowling pins fall to the playing surface, and whereby the bowling ball is then retained;

re-configuring the bowling pins whereby the bowling pins hang above the playing surface;

retrieving the bowling ball; and the second player rolling the bowling ball towards the bowling pins, whereby the bowling ball contacts one or more of the bowling pins whereby said one or more of the bowling pins fall to the playing surface, and whereby the bowling ball is then retained.

20. The method of claim 19, wherein the playing surface is an even playing surface.

21. The method of claim 19, wherein the playing surface is an uneven playing surface.

* * * * *